United States Patent [19]

Osgood

[11] Patent Number: 5,074,675

[45] Date of Patent: Dec. 24, 1991

[54] THERMOPLASTIC BAG WITH METALLIZED END GUSSET

[75] Inventor: W. Robert Osgood, Farmington, N.Y.

[73] Assignee: Mobil Oil Corporation, Fairfax, Va.

[21] Appl. No.: 574,461

[22] Filed: Aug. 28, 1990

[51] Int. Cl.[5] ..... B65D 30/08

[52] U.S. Cl. ..... 383/122; 383/106; 383/107; 383/116; 383/120; 229/87.09; 493/187

[58] Field of Search ..... 383/104, 106, 107, 116, 383/120, 122; 229/87.08, 87.09, 87.03, 87.06, 35 MF; 493/187, 188, 189

[56] References Cited

U.S. PATENT DOCUMENTS

| | | | |
|---|---|---|---|
| 2,047,980 | 7/1936 | Olm et al. | 229/87.06 X |
| 2,048,213 | 7/1936 | Grogan | 229/87.09 X |
| 3,182,893 | 5/1965 | Bremkamp | 229/87.09 |
| 3,269,278 | 8/1966 | Olstad | 383/116 X |
| 3,285,497 | 11/1966 | Stillman et al. | 383/106 X |
| 3,355,303 | 11/1967 | Meyers | 383/106 X |
| 3,386,645 | 6/1968 | Powell | 383/106 |
| 3,402,052 | 9/1968 | Walker | 229/87.09 X |

FOREIGN PATENT DOCUMENTS

| | | | |
|---|---|---|---|
| 908739 | 4/1946 | France | 229/87.06 |

*Primary Examiner*—Stephen Marcus
*Assistant Examiner*—Jes F. Pascua
*Attorney, Agent, or Firm*—Alexander J. McKillop; Charles J. Speciale

[57] ABSTRACT

The present invention is a bag of thermoplastic film material which includes a top wall and a bottom wall connected by first and second sidewalls and having an open end and a closed end. The closed end includes an end gusset wherein there are two lateral edge heat seals. The lateral edge heat seals are formed by a four-fold gusset. The outer surface of one of the folds can be provided with a metallic surface whereas the outer surface of a mating fold in the gusset possesses a non-metallic surface. As a result of the present invention, a metallized end-fold gusset can be provided with a capability of heat sealing the lateral edges in the metallized area.

6 Claims, 2 Drawing Sheets

THERMOPLASTIC BAG WITH METALLIZED END GUSSET

BACKGROUND OF THE INVENTION

The present invention relates to thermoplastic bags useful for packaging bread and other food products and, in particular, metallized thermoplastic bags useful for packaging such products on high speed automatic loading equipment.

The food industry has used thermoplastic bags to package bread and other products for many years. Typically, these bags are formed of some blend of polyethylene or similar polymers and are advantageous in maintaining freshness as well as allowing the consumer to view the product. In many, if not most cases, these bags are manufactured from rolls of continuous film which is folded and heat sealed to form the desired bag product. Commonly, the resulting bags will have an open end and a closed end that contains a series of folds and heat seals which form what is known as an end gusset.

The completed bags are used by food packagers on automated high-speed loading equipment which applies high stress to the heat sealed portions of the end gusset during the loading process. In order to maintain an air-tight integrity, the heat seals must be of sufficient strength to withstand the loading stresses.

The packaging industry has often sought to increase consumer appeal for a particular product by varying the surface of the package containing the product. In the bread industry, for example, many of the thermoplastic bags used for packaging are labeled or coated in such a way as to attract consumers. Bread and other products which are contained in bags are typically placed on the store shelf with the closed or gusseted end facing the consumer. It is, therefore, desirable to coat or label the gusseted portion of these bags.

Decorative labels or coatings must be applied to the thermoplastic film prior to folding or heat sealing. The most common approach to such labeling or coating includes feeding a continuous roll of film through a surface coating process or printer where the desired design or surface coating is continuously applied.

One method of coating known as metallization involves applying a metallized surface to the thermoplastic film. Aluminum can be deposited on the surface of the film in a continuous sheet or strip which runs along the entire length of the film. The metal must be deposited in a unidirectional process in continuous sheets or strips. Consequently, design gaps or breaks in the metallized surface cannot be directed to the film on a site-specific basis. Therefore, this application process inherently has limitations, especially when manufacturers attempt to direct the placement of a metallized surface to the portion of the bag which results in the end gusset area.

Another major problem with metallized thermoplastic film is that it tends to form weak heat seals in any areas in which two metallized film surfaces contact one another to form a seal.

Previous attempts to place a metallized surface in the end gusset area of thermoplastic bags used on automatic loading equipment have been unsuccessful because the resulting heat seals in the gusset area were not able to withstand the stress incurred during the loading operation.

It is, therefore, an object of the present invention to provide a thermoplastic bag with an end gusset having both a metallized surface and adequate heat seal strength for use on automatic packaging or loading equipment.

SUMMARY OF THE INVENTION

The present invention is a thermoplastic bag having a metallized surface present in the end gusset portion of the bag. The completed bag includes a top wall and a bottom wall which are connected to one another by two parallel sidewalls. Each of the sidewalls contain a side seal which runs along the length of the bag and is formed by heat sealing two film layers together. The bag has an open end and a closed end which has an end gusset formed therein.

The end gusset is formed using a series of folds and two lateral edge heat seals and is divided into a top half and a bottom half by the gusset midline. The two lateral edge heat seals are positioned opposite one another and are best seen at the lateral edges of the end gusset when the bag is collapsed. These lateral edge heat seals are continuous with the side seals of the bag, but contain four film layers rather than two film layers as are present in the side seals. The presence of the two additional film layers is due to the film folds placed in the end gusset.

Prior to heat sealing, these gusset folds can be seen in lateral cross-section to resemble the letter "M" resting on its side. The center point of the "M" corresponds to the midline of the gusset. One outer leg of the "M" is continuous with the top wall of the bag while the other outer leg is continuous with the bottom wall of the bag. One inner leg of the "M" corresponds to the upper half of the gusset and the other inner leg to the lower half. Therefore, prior to heat sealing, each section of the gusset area can be seen to have an inner surface aspect which faces the inside of the bag and an outer surface aspect which faces the outside of the bag.

A heat sealing apparatus delivers heat along the entire length of both longitudinal edges of the folded film, forming the two side seals which run lengthwise along the body of the bag as well as forming the two lateral edge heat seals which are located opposite one another at the lateral edges of the end gusset. As previously mentioned, each of these lateral edge heat seals are continuous with the side seal located on the corresponding side of the bag, but contain four film layers rather than two film layers, as are present in the side seal. Upon the application of heat, the four film layers present at each lateral edge of the end gusset are forced into contact with one another. The inner surface aspect of the top wall of the bag contacts the inner surface aspect of the upper half of the gusset while the inner surface aspect of the bottom wall of the bag contacts the inner surface aspect of the lower half of the gusset. In addition, the outer surface aspect of the top half of the gusset by necessity must contact the outer surface aspect of the bottom half of the gusset. The interface between these two outer surface aspects in the area of the lateral edge heat seals is critical when attempting to achieve adequate end gusset strength in thermoplastic bags having a metallized surface in the end gusset region.

Previous attempts at manufacturing such bags failed to yield adequate seal strength in the end gusset for use on automatic loading equipment because both outer surface aspects were metallized. The resulting metal-to-metal interface inhibited the integrity of the end gusset seals formed by conventional heat sealing techniques.

The thermoplastic bag of the present invention provides for both a metallized surface in the end gusset region and sufficient end gusset seal strength by eliminating any metal-to-metal contact in the lateral edge heat seals of the end gusset while simultaneously retaining a metallized surface within the end gusset.

For a better understanding of the present invention, together with other and further objects, reference is made to the following description taken in conjunction with the accompanying drawings and its scope will be pointed out in the appended claims.

DETAILED DESCRIPTION OF THE PREFERRED EMBODIMENTS

Figure 1:
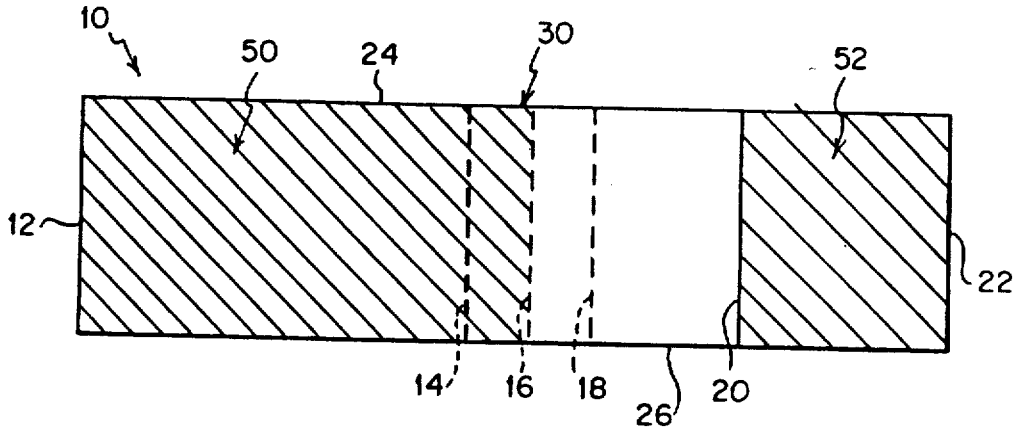
FIG. 1 is a plan view of a bag unfolded and unassembled.

Referring to FIG. 1, a single sheet of thermoplastic film 10 having metallized surface portions 50 and 52 is shown. It is important to note that the thermoplastic bags of the present invention are not manufactured in single sheets but are mass produced from a continuous roll of film.

The exact composition of the thermoplastic film 10 is not critical to the invention except that the composition should be sealable using conventional heat sealing techniques and able to retain a metallic coating such as aluminum or other metals suitable for application to thermoplastic films. Suitable polymers for the film used in this invention include, for example: polyethylene, low density polyethylene, ethylene-vinyl acetate copolymer, linear low density polyethylene, polypropylene, high density polyethylene, Surlyn TM ionomers, ethylene-propylene copolymers, polyethyl acrylate, polymethyl methacrylate, modified polyesters, polyethylene-acrylic acid, polyethylene methacrylic acid and mixtures and copolymers of these materials. In addition, coextrudates of two or more of the polymers mentioned above would also be acceptable film compositions for the present invention.

Figure 2:
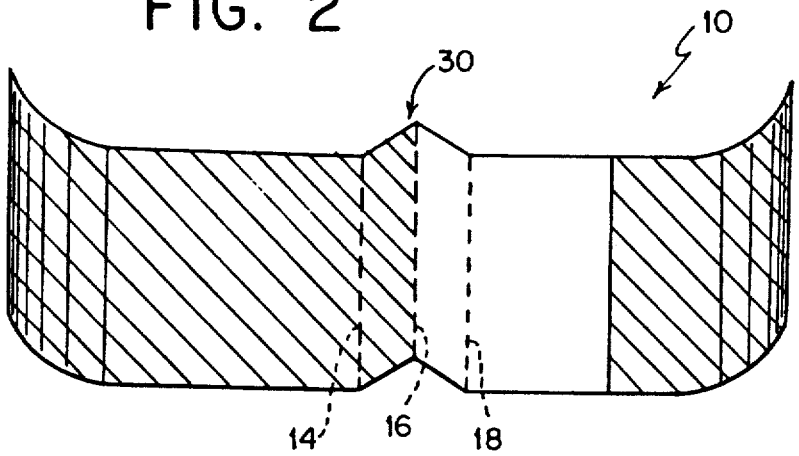
FIG. 2 is a schematic of the bag shown in FIG. 1 depicting the folding scheme for assembling the bag.

The thermoplastic film 10 will have been previously treated with aluminum or other suitable metal to produce the desired metallized surfaces on one side of the film as shown in FIGS. 1 and 2. As previously mentioned, the orientation of the metallized surfaces on the film is limited to continuous sheets or strips due to constraints in current methods of applying metallized surfaces to thermoplastic films.

Figure 3:
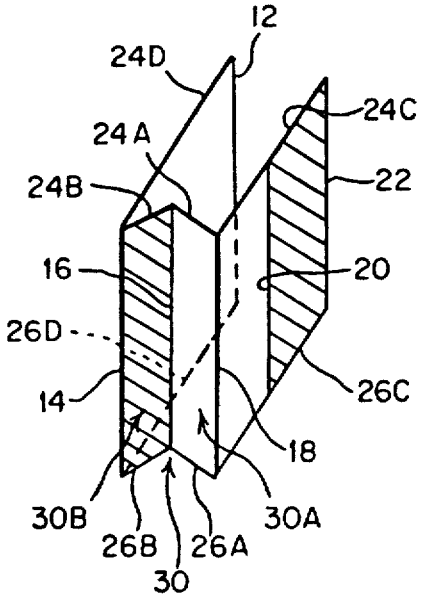
FIG. 3 is a schematic of the bag shown in FIGS. 1 and 2 folded further toward the fully assembled condition.
Figure 4:
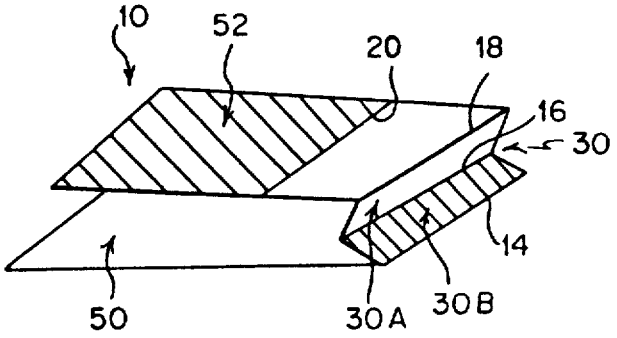
FIG. 4 is a perspective view of the bag as shown in FIG. 3.

Referring to FIGS. 3 and 4, the film 10 is subsequently folded at lines 14, 16 and 18 to achieve a pocket-like configuration which will ultimately become the end gusset 30. The top wall 52 of the bag 10 will be formed from the area of film bounded by lines 18, 22, 24C and 26C. See FIG. 3. The bottom wall 50 of the bag 10 will be formed from the area of the film bounded by lines 14, 12, 24D and 26D.

Figure 7:
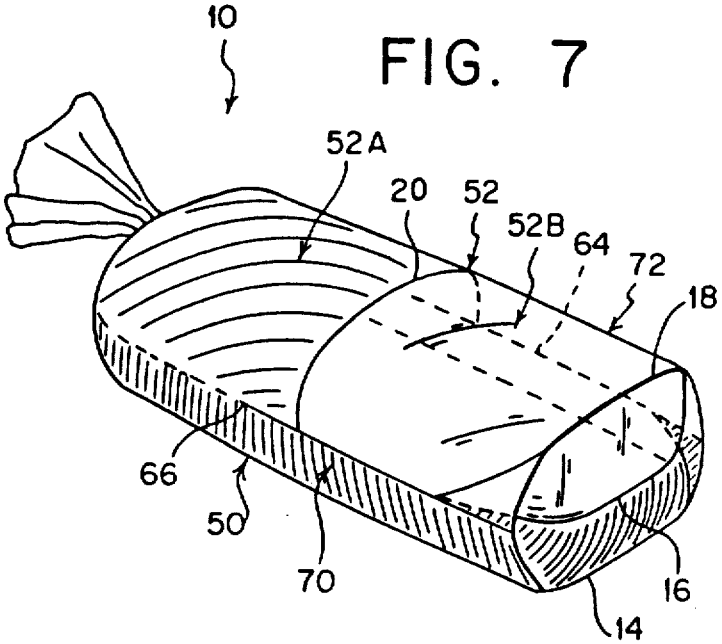
FIG. 7 is a schematic of a fully assembled bag bearing product therein.

Referring to FIGS. 2 and 3, the end gusset 30 will be formed from the area of film bounded by lines 14, 18, 24A, 24B, 26A and 26B. Referring to FIGS. 3 and 4, end gusset midline 16 bisects the end gusset 30 into a top half 30A and a bottom half 30B. The top half 30A is bounded by lines 18, 16, 24A and 26A, and the bottom half 30B is bounded by lines 14, 16, 24B and 26B. Referring to FIG. 7, which shows the completed bag expanded to hold the desired product, the sidewalls 70 and 72 will be formed of a continuation of top surface 52 and bottom surface 50 joined together at side seals 66 and 64.

Figure 5:
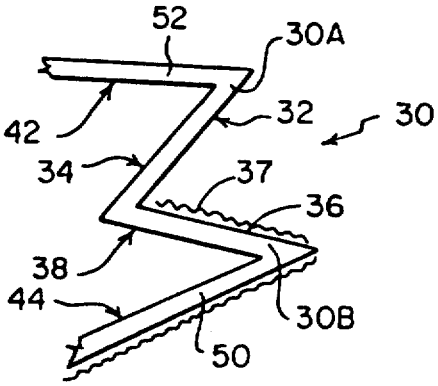
FIG. 5 is a cross-section, in side elevation of the gusset fold of the bag shown in FIG. 4

The end gusset 30 is formed using three folds made in film 10 along lines 14, 16 and 18 as shown in FIGS. 2-5. Prior to heat sealing, the gusset folds can be seen in lateral cross-section to resemble the letter "M" resting on its side, as best seen in FIGS. 4 and 5. Referring in particular to FIG. 5, end gusset 30 can be seen in a cross-sectional view to include the top half 30A and the bottom half 30B. Top half 30A includes an outer surface aspect 32 which faces the outside of the completed bag and an inner surface aspect 34 which faces the inside of the bag. Similarly, bottom half 30B includes an outer surface aspect 36 which faces the outside of the completed bag and an inner surface aspect 38 which faces the inside of the bag.

Figure 6:
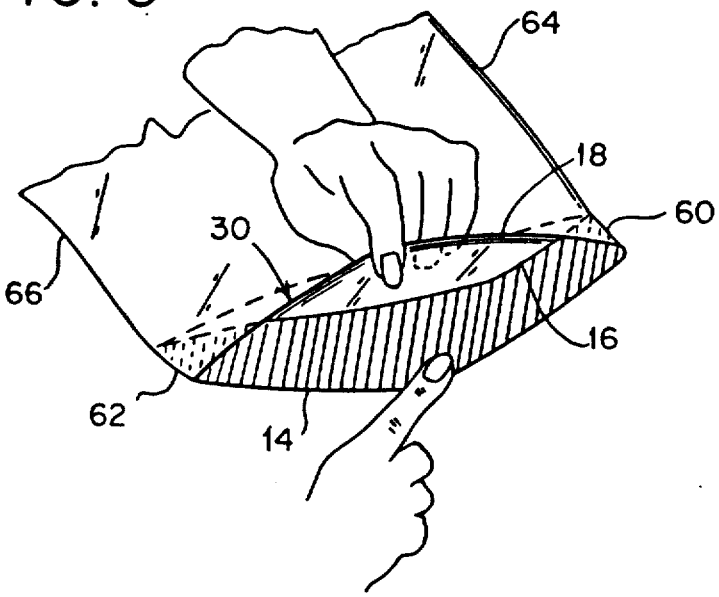
FIG. 6 is a schematic of the bag shown in FIG. 4 in the collapsed condition.

FIG. 6 shows the folded film 10 of FIG. 4 after it has been collapsed and heat sealed. The collapsed orientation of the film in FIG. 6 yields a four-layer thickness of film in the gusset area and a two-layer thickness of film in the remainder of the structure. Lateral edge heat seals 60 and 62, which are located opposite one another at the lateral edges of end gusset 30, are simultaneously formed with side seals 64 and 66 by a heat sealing apparatus which delivers heat along the entire length of both longitudinal edges of the film 10. An appropriate heat sealing apparatus includes a hot knife or hot wire-type or any other such apparatus known in the art capable of forming an edge bead weld.

In order to properly form lateral edge heat seals 60 and 62 and side seals 64 and 66, two or more layers of film material must melt and flow together. Therefore, any non-film material such as a metallized surface present between the layers of film will inhibit good sealing. This has been observed in the past with printing inks which were commonly left out of the end gusset seal areas.

FIG. 5 shows a sectional view of the four film layers which will be collapsed to contact one another and form lateral edge heat seals 60 and 62 shown in FIG. 6. The inner surface aspect 42 of top wall 52 will contact the inner surface aspect 34 of the top half 30A of end gusset 30 while the inner surface aspect 44 of bottom wall 50 will contact the inner surface aspect 38 of the bottom half 30B of end gusset 30. In addition, the outer surface aspect 32 of the top half 30A of end gusset 30 will contact the outer surface aspect 36 of the bottom half 30B of end gusset 30.

The interface between the outer surface aspects 32 and 36 shown in FIG. 5 is critical when attempting to achieve adequate gusset seal strength in lateral edge heat seals 60 and 62. Accordingly, FIG. 5 shows outer surface aspect 36 of the bottom half 30B of end gusset with metallized surface 37 while the outer surface aspect 32 of the to half 30A of end gusset 30 has a non-metallized film surface. Alternatively, the outer surface aspect 32 could be provided with the metallized surface while outer surface aspect 36 would have a non-metallized surface.

In yet another embodiment of the invention, either of outer surface aspects 32 or 36 could be provided with alternating strips of metallized and non-metallized film which would be oriented parallel to gusset midline 16. In such an embodiment, the remaining outer surface aspect must contain an entirely non-metallized film surface or an opposite sequence of alternating metallized and non-metallized strips having approximately the same dimensions in order to avoid any metal-to-metal contact in lateral edge heat seals 60 and 62.

While it is possible to make a thermoplastic bag wherein both outer surface aspects 32 and 36 are entirely covered with a metallized surface, the resulting lateral edge heat seals 60 and 62 would be unacceptable for use on automatic loading equipment. In order for lateral edge heat seals 60 and 62 shown in FIG. 6 to have sufficient end gusset strength for use on automatic equipment, it is critical that either outer surface aspect 32 or 36 have a non-metallized film surface in the area where the film is heat sealed. While the remainder of both outer surface aspects 32 and 36 could be provided with a metallized surface due to the fact that these areas are not involved in the formation of lateral edge heat seals 60 and 62, constraints in the art of applying metallized surfaces to thermoplastic films prevent such an embodiment.

Currently, metallized surfaces must be applied in a continuous sheet or strips. Spot metallizing techniques that provide for greater flexibility in directing the metallized surface coating to particular portions of the film while excluding others, are not available. As a result of this limitation, when either the top half 30A or the bottom half 30B of end gusset 30 is entirely metallized, the remaining gusset half must retain an entirely non-metallized film surface. In short, by limiting the metal in lateral edge heat seals 60 and 62 to one layer between contacting surfaces, an adequate end gusset seal will be produced.

With respect to the areas of the film 10 not involved in forming end gusset 30, the film can be either partially or completely metallized according to other considerations of the manufacturer. For example, referring to FIG. 7, the border 20 between metallized top surface 52A and non-metallized top surface 52B could have been placed anywhere along top surface 52 to allow the consumer either a larger or smaller view of the product contained therein.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A bag of thermoplastic film material comprising:

a top wall and a bottom wall connected by a first and a second side wall and having an open end and a closed end, said closed end including an end gusset having at least one lateral edge heat seal, said end gusset containing a metallized surface portion and a non-metallized surface portion, wherein at least a part of said metallized surface portion and at least part of said non-metallized surface portion are incorporated into said lateral edge heat seal and wherein said part of said metallized surface portion contacts said part of said non-metallized surface portion.

2. The bag of claim 1 wherein said end gusset has a top half and a corresponding bottom half and wherein said metallized surface portion is entirely contained alternatively on either of said halves.

3. The bag of claim 1 wherein said end gusset has a first and a second lateral edge heat seal wherein said metallized surface portion is present in said lateral edge heat seals.

4. The bag of claim 1 wherein said end gusset includes a first and a second lateral edge heat seal, each of said lateral edge heat seals formed of a four-layer thickness of thermoplastic film material and wherein each of said layers of film material has an outer surface aspect and an inner surface aspect, said outer surface aspect of one of said layers having a sequence of alternating metallized and non-metallized film areas and contacting said outer surface aspect of another said layers having an opposite sequence of alternating metallized and non-metallized film areas.

5. A bag of thermoplastic film material comprising:

a top wall and a bottom wall connected by a first and a second sidewall and having an open end and a closed end, said closed end including an end gusset, wherein said end gusset includes a first and a second lateral edge heat seal, each of said lateral edge heat seals formed of a four-layer thickness of thermoplastic film material and wherein each of said layers of film material has an outer surface aspect and an inner surface aspect, said outer surface aspect of one of said layers of film material having a metallized surface, said metallized surface contacting said outer surface aspect of another of said layers of film material having a non-metallized surface.

6. A process for making a thermoplastic bag with an end gusset comprising:

a) folding a film of thermoplastic material to create a series of panels defining said end gusset, one of said panels having an outer surface which mates with an outer surface of another of said panels;

b) applying a metallized coating to said outer surface of said one of said panels;

c) retaining a non-metallized film surface on said outer surface of said other of said panels; and d) heat sealing a first and a second lateral edge of said panels to form said end gusset.

* * * * *